US008087522B2

(12) United States Patent
Stafford et al.

(10) Patent No.: US 8,087,522 B2
(45) Date of Patent: Jan. 3, 2012

(54) QUICK SECURE SHELVING

(75) Inventors: William Y. Stafford, Minnetrista, MN (US); Nick Quang Trinh, Minneapolis, MN (US); Benjamin Weshler, Old Westbury, NY (US)

(73) Assignee: Target Brands, Inc., Minneapolis, MN (US)

( * ) Notice: Subject to any disclaimer, the term of this patent is extended or adjusted under 35 U.S.C. 154(b) by 438 days.

(21) Appl. No.: 12/257,252

(22) Filed: Oct. 23, 2008

(65) Prior Publication Data

US 2009/0294392 A1 Dec. 3, 2009

Related U.S. Application Data

(63) Continuation-in-part of application No. 12/154,792, filed on May 27, 2008.

(51) Int. Cl.
*A47G 29/087* (2006.01)

(52) U.S. Cl. ..... 211/119.003; 211/90.02; 211/193; 108/108

(58) Field of Classification Search ..... 211/119.003, 211/88.01, 90.01–90.04, 103, 187, 190, 207, 211/193, 70.6; 248/220.22, 220.31, 222.12, 248/224.8; 108/106–108, 60, 61, 147.17; 206/477, 486, 490; 24/458
See application file for complete search history.

(56) References Cited

U.S. PATENT DOCUMENTS 1,462,108 A 7/1923 Holywell
1,573,358 A * 2/1926 Ross ..... 434/407
1,739,730 A 12/1929 Orthwine
1,975,691 A * 10/1934 Hibbs ..... 211/65
1,992,712 A * 2/1935 Mojonnier ..... 493/121
2,984,488 A * 5/1961 Kirchner ..... 273/157 R
3,154,209 A * 10/1964 Wilhite et al. ..... 217/21
3,154,281 A * 10/1964 Frank ..... 248/201
3,482,709 A * 12/1969 Larson ..... 211/187
3,568,357 A * 3/1971 Lebensfeld ..... 446/91
3,900,112 A * 8/1975 Azzi et al. ..... 211/187
4,477,142 A * 10/1984 Cooper et al. ..... 439/575
4,486,169 A 12/1984 Lewis
4,540,222 A 9/1985 Burrell
4,620,489 A * 11/1986 Albano ..... 108/105
4,901,869 A 2/1990 Hawkinson et al.

(Continued)

OTHER PUBLICATIONS

William Y. Stafford et al., "Shelf Assembly," U.S. Design Application, filed Oct. 23, 2008 (8 pgs.).

(Continued)

*Primary Examiner* — Darnell Jayne
*Assistant Examiner* — Devin Barnett
(74) *Attorney, Agent, or Firm* — Nixon & Vanderhye P.C.

(57) ABSTRACT

A shelving system includes a product, a base, a tray insert, a template, and a placement clip. The base has a top surface forming a receptacle and includes a hanger assembly for releasably securing the base to a shelving unit positioned in a retail environment. The tray insert is releasably secured into the receptacle formed in the top surface of the base. The tray insert has a plurality of slots spaced along a length of the tray insert. The template is received over the tray insert to cover the tray insert. The template has a plurality of openings through the tray insert to selectively expose a desired subset of slots. The placement clip is releasably secured through one of the openings in the template into a pair of the desired subset of slots. The placement clip acts to releasably secure the template to the tray insert and is adapted to maintain the product.

9 Claims, 10 Drawing Sheets

U.S. PATENT DOCUMENTS

| | | | | | |
|---|---|---|---|---|---|
| 4,938,442 | A | * | 7/1990 | Mastrodicasa | 248/250 |
| 5,059,053 | A | | 10/1991 | Rose | |
| 5,111,942 | A | | 5/1992 | Bernardin | |
| 5,124,685 | A | | 6/1992 | Rankin | |
| 5,207,150 | A | * | 5/1993 | Wellman et al. | 99/439 |
| 5,390,998 | A | | 2/1995 | Friedman | |
| 5,464,105 | A | * | 11/1995 | Mandeltort | 211/184 |
| 5,595,310 | A | | 1/1997 | Spamer et al. | |
| 5,622,010 | A | | 4/1997 | Weber | |
| 5,673,801 | A | | 10/1997 | Markson | |
| 5,685,436 | A | | 11/1997 | Davet | |
| 5,749,478 | A | * | 5/1998 | Ellis | 211/59.2 |
| 5,865,476 | A | | 2/1999 | Kramer | |
| 5,873,641 | A | | 2/1999 | Spinelli | |
| 5,878,895 | A | | 3/1999 | Springs | |
| 5,926,922 | A | | 7/1999 | Stottle | |
| 5,975,318 | A | * | 11/1999 | Jay | 211/90.01 |
| 5,984,439 | A | | 11/1999 | Orr et al. | |
| 5,992,652 | A | | 11/1999 | Springs | |
| 6,021,908 | A | * | 2/2000 | Mathews | 211/90.02 |
| 6,161,708 | A | * | 12/2000 | Myler | 211/90.02 |
| 6,168,032 | B1 | | 1/2001 | Merl | |
| 6,290,077 | B2 | * | 9/2001 | Sosso | 211/189 |
| D453,272 | S | * | 2/2002 | Meyer | D6/407 |
| 6,357,609 | B1 | * | 3/2002 | Van Noord et al. | 211/90.02 |
| 6,476,717 | B1 | | 11/2002 | Gross et al. | |
| 6,497,461 | B1 | | 12/2002 | Harlan | |
| 6,543,095 | B2 | | 4/2003 | Sedlmeier | |
| 6,752,277 | B1 | * | 6/2004 | Sempliner | 211/59.3 |
| 6,761,579 | B2 | | 7/2004 | Fort et al. | |
| 7,124,897 | B2 | | 10/2006 | Bustos | |
| 7,150,365 | B2 | | 12/2006 | Hardy et al. | |
| 7,152,536 | B2 | | 12/2006 | Hardy | |
| D540,566 | S | | 4/2007 | Scholen et al. | |
| 7,201,440 | B2 | * | 4/2007 | Heck et al. | 297/148 |
| 7,287,652 | B2 | * | 10/2007 | Scholen et al. | 211/26 |
| 7,299,934 | B2 | | 11/2007 | Hardy et al. | |
| 7,340,855 | B2 | | 3/2008 | Wiltfang et al. | |
| 7,523,898 | B1 | * | 4/2009 | Barry et al. | 248/71 |
| 7,587,796 | B1 | | 9/2009 | Schultz | |
| 7,686,185 | B2 | | 3/2010 | Zychinski | |
| 2001/0035385 | A1 | * | 11/2001 | Sosso | 211/184 |
| 2002/0027115 | A1 | * | 3/2002 | Gay et al. | 211/187 |
| 2002/0162201 | A1 | | 11/2002 | Liu | |
| 2003/0205545 | A1 | * | 11/2003 | Moceri | 211/90.02 |
| 2004/0050811 | A1 | * | 3/2004 | Leahy et al. | 211/134 |
| 2004/0182805 | A1 | * | 9/2004 | Harper | 211/90.02 |
| 2005/0082450 | A1 | | 4/2005 | Barrett et al. | |
| 2005/0232682 | A1 | | 10/2005 | Aguirre et al. | |
| 2005/0247649 | A1 | | 11/2005 | Scholen et al. | |
| 2005/0263465 | A1 | * | 12/2005 | Chung | 211/90.02 |
| 2006/0139170 | A1 | | 6/2006 | Ott | |
| 2006/0273706 | A1 | | 12/2006 | Champagne et al. | |
| 2007/0035699 | A1 | | 2/2007 | McKee | |
| 2007/0085456 | A1 | | 4/2007 | Farrens | |
| 2007/0144543 | A1 | | 6/2007 | Simon | |
| 2007/0187346 | A1 | | 8/2007 | Markson et al. | |
| 2010/0294896 | A1 | * | 11/2010 | Sayilgan | 248/73 |

OTHER PUBLICATIONS

Benjamin Weshler, "Product Display Assembly and Tester Security Apparatus," U.S. Appl. No. 12/154,792, filed May 27, 2008 (25 pgs.). Exhibit A, Wireless Phone Holder System with Pull Box (Tethered) believed to have been used publicly in Target stores before May 27, 2007.

* cited by examiner

QUICK SECURE SHELVING

CROSS-REFERENCE TO RELATED APPLICATIONS

This application is a continuation-in-part of U.S. patent application Ser. No. 12/154,792, filed May 27, 2008, entitled "PRODUCT DISPLAY ASSEMBLY AND TESTER SECURITY APPARATUS," which is incorporated herein by reference in its entirety.

BACKGROUND

A variety of different types of product displays are used in retail environments. Product displays are often used with removable or adjustable shelving to support and display products. Generally speaking, the merchandising of a product line, type of product, or product combination, for example, is enhanced through product displays that are aesthetically pleasing, easy to assemble and disassemble, and customizable to suit the display needs of a variety of products and product combinations.

SUMMARY

Various aspects of the invention relate to systems, assemblies, and methods of displaying products.

In some embodiments, a shelving system includes a product, a base, a tray insert, a template, and a placement clip. The base has a top surface forming a receptacle and includes a hanger assembly for releasably securing the base to a shelving unit positioned in a retail environment. The tray insert is releasably secured into the receptacle formed in the top surface of the base. The tray insert has a plurality of slots spaced along a length of the tray insert. The template is received over the tray insert to cover the tray insert. The template has a plurality of openings through the tray insert to selectively expose a desired subset of slots. The placement clip is releasably secured through one of the openings in the template into a pair of the desired subset of slots. The placement clip acts to releasably secure the template to the tray insert and is adapted to maintain the product.

Figure 1:
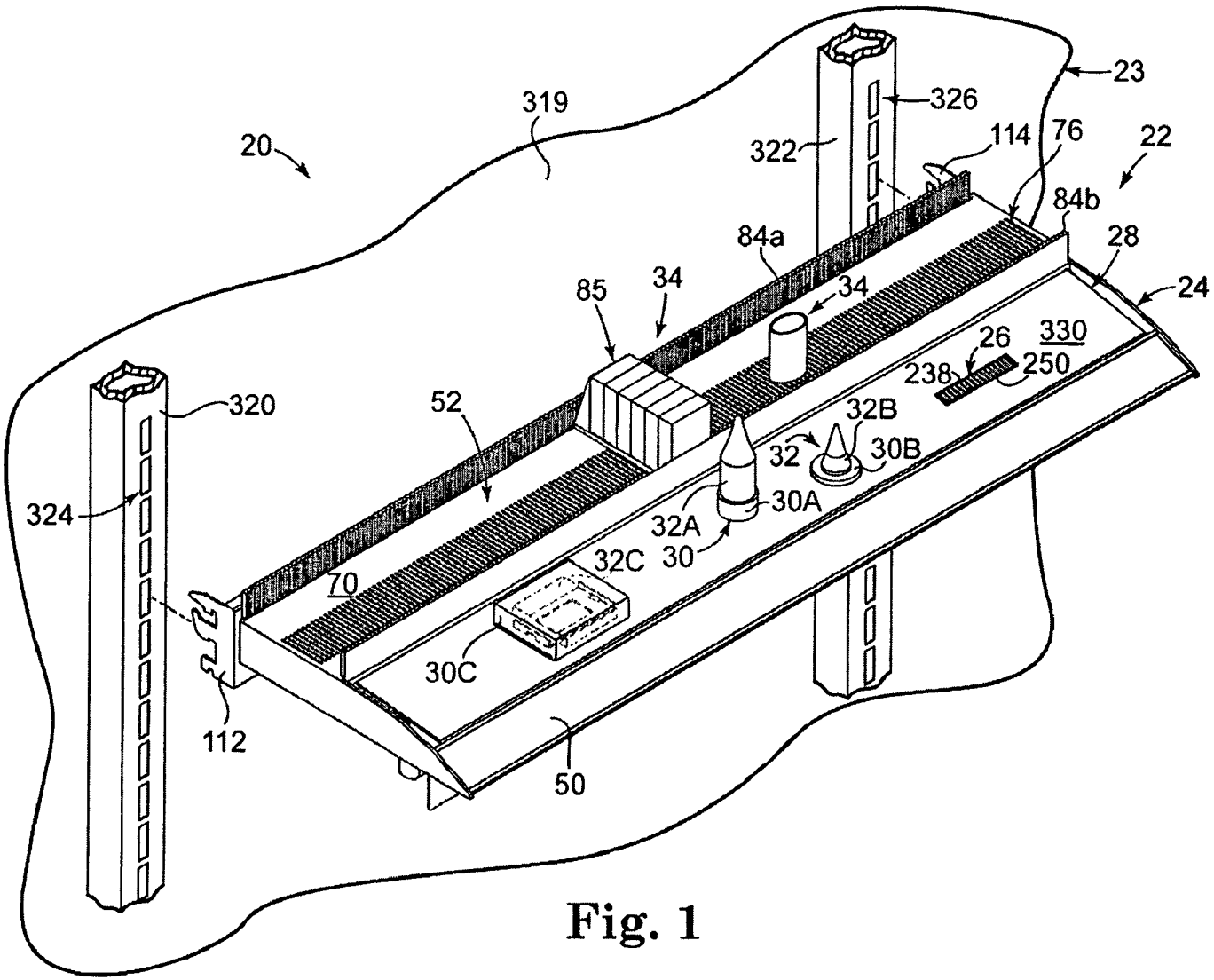
FIG. 1 is a isometric view of a shelving system, according to some embodiments.

Some embodiments have been shown by way of example in the drawings and are described in detail below. As stated above, the intention, however, is not to limit the invention by providing such examples.

DETAILED DESCRIPTION

In general terms, various embodiments address a versatile shelving system adapted to allow relatively quick product assembly to and removal from product shelving. In some embodiments, the products are displayed in a tiered set up. At least one product tier is optionally angled toward a viewer standing in front of the shelving system to facilitate product viewing and access. In some embodiments, a plurality of shelves are provided and adjusted to form staggered and waterfall effects, each shelf projecting a different distance outwardly from an associated shelving unit. Although some embodiments incorporate the above-described features, additional and/or alternate features and combinations thereof are contemplated.

Figure 2:
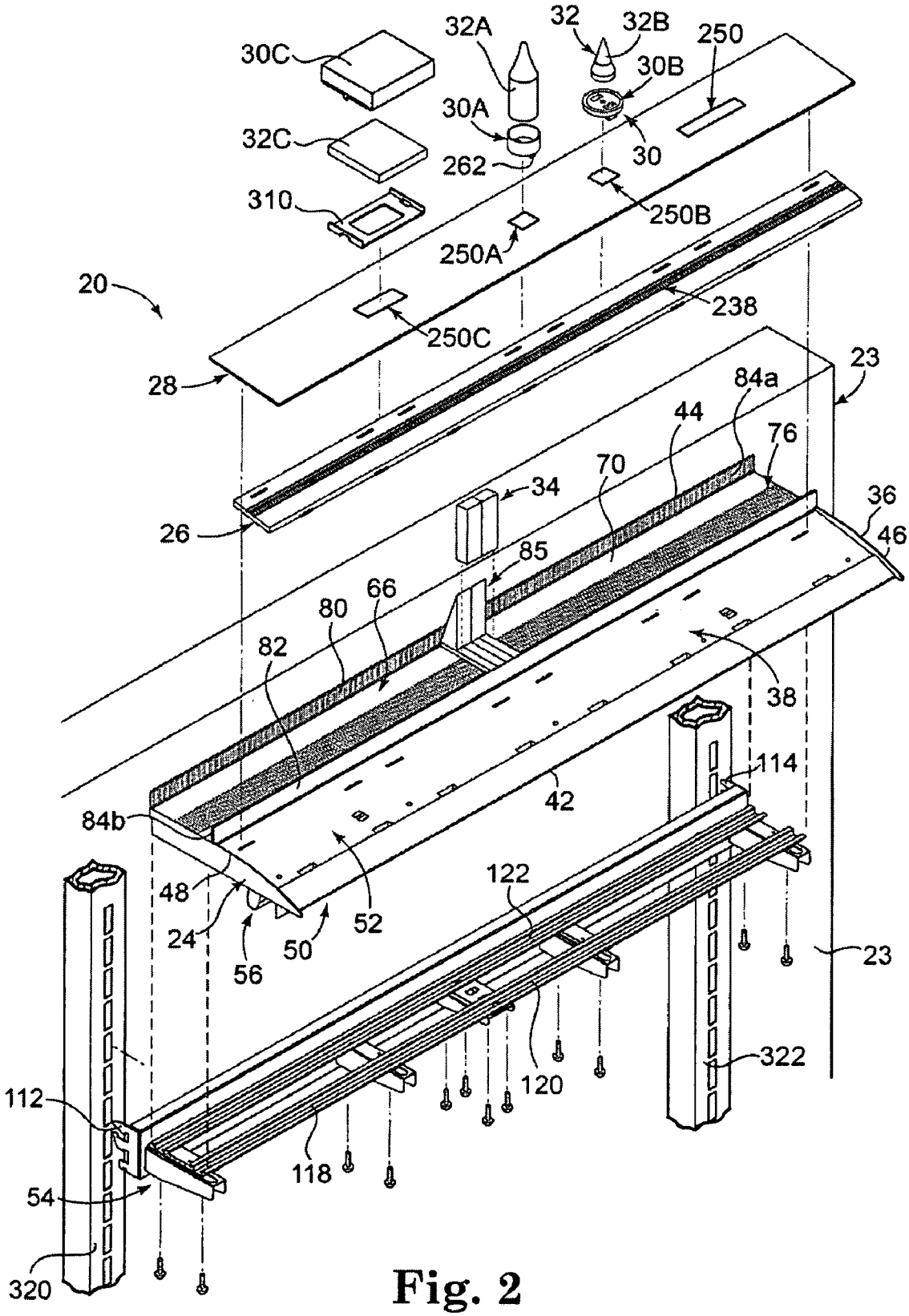
FIG. 2 is an isometric view of the shelving system of FIG. 1, according to some embodiments.
Figure 3:
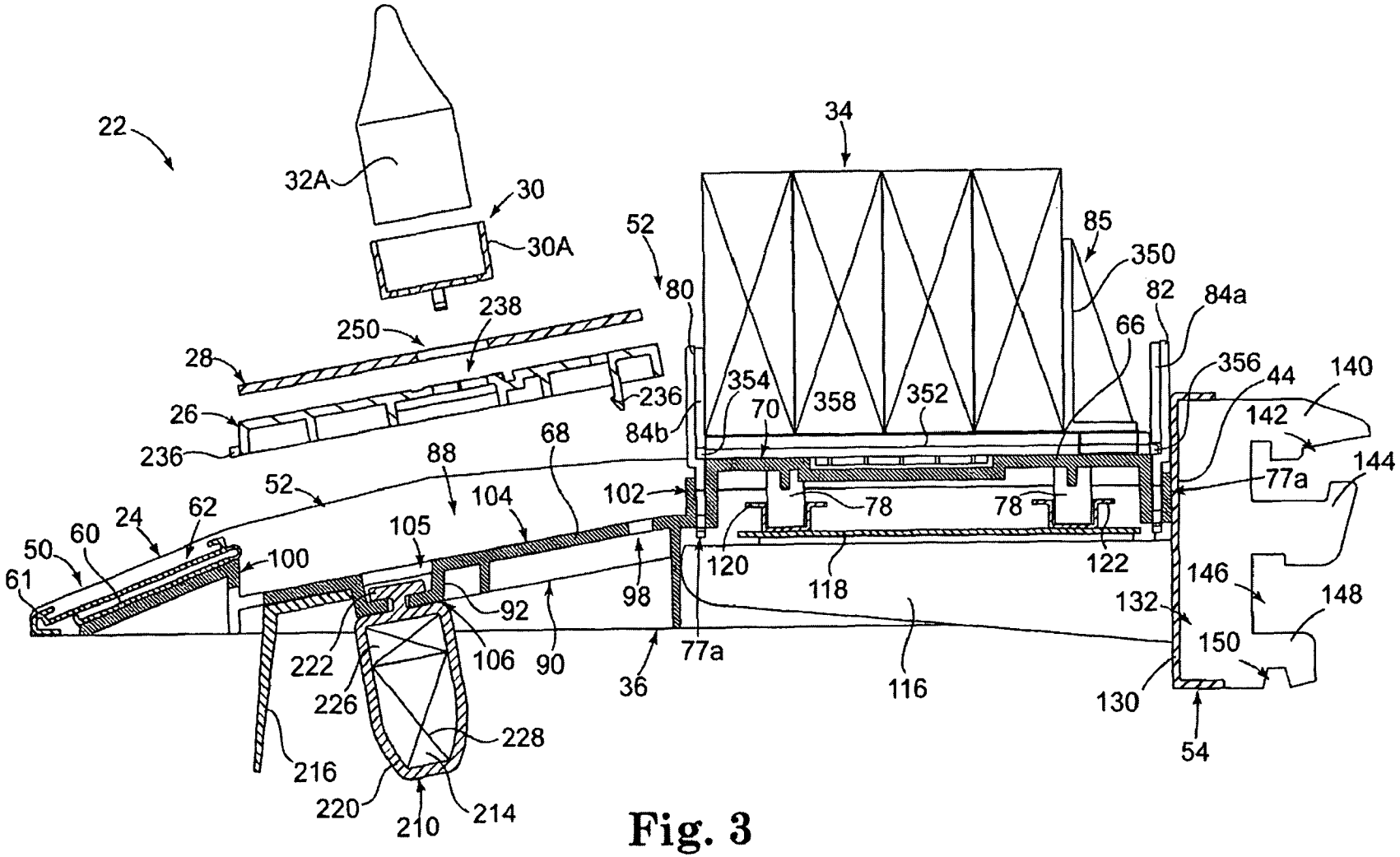
FIG. 3 is a side, cross-sectional view of the shelving system of FIG. 1, according to some embodiments.

FIG. 1 is an isometric view of a shelving system 20, or display system, for maintaining and displaying merchandise. FIG. 2 is an isometric view of the shelving system 20 in a disassembled state. As shown, the shelving system 20 optionally includes a shelf 22 adapted to be releasably secured to a shelving unit 23 positioned in a retail environment (e.g., a store). FIG. 3 is a cross-sectional view of the shelf 22. As shown in FIGS. 1-3, the shelf 22 (also described as a shelf assembly) includes a tray assembly 24, tray insert 26 releasably secured to the tray assembly 24, a template 28 received over the tray insert 26 to cover or mask portions of the tray insert 26, and a plurality of placement clips 30, also described as product holders, releasably secured through the template 28 into the tray insert 26. The system 20 also optionally includes a lower tier of products 32 maintained by the placement clips 30, also described as support articles, and an upper tier of products 34 maintained by the tray assembly 24. As generally shown in FIG. 1, the lower and upper tiers of products 32, 34 optionally include bottled and boxed cosmetics and related products, although a variety of items are contemplated.

As shown in FIG. 2, the tray assembly 24, also described as a base or a support unit includes a base tray 36, the base tray 36 having a top 38, a bottom 40 (FIG. 5), a front 42 or front edge, and a back 44, or back edge and including a first side 46, a second side 48, a display portion 50, and a support portion 52. The tray assembly 24 also includes bracket assembly 54, at the back 44, and a lighting assembly 56. The tray assembly 24 and its components are optionally formed of any of a variety of materials, including molded and/or machined polymeric materials such as polypropylenes, styrenes, and others and are optionally formed, machined and/or cast, from metallic materials such as sheet metals, steels, aluminum alloys, and others as appropriate.

Each of the first and second sides 46, 48 is a substantially flat, thin, and wedge-shaped piece secured at one side of the base tray 36. The first and second sides 46, 48 are optionally formed continuously with the display portion 50 (e.g., via injection molding) and the support portion 52 as a single piece or as separate, but connected parts (e.g., via adhesives or welding) with the display and support portions 50, 52.

Figure 4:
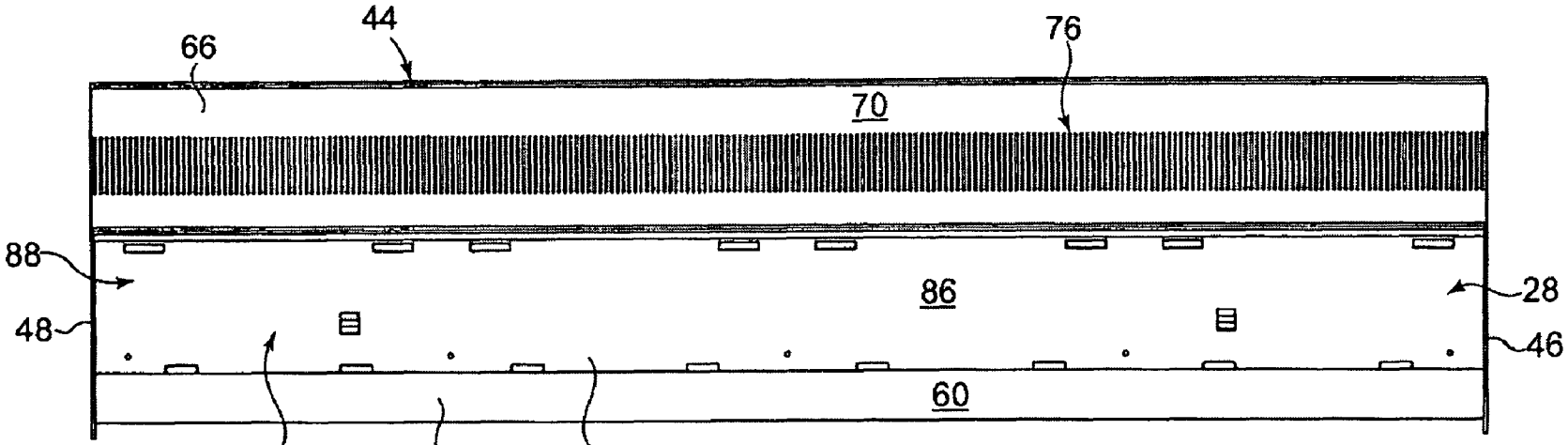
FIG. 4 is a top view of a base tray of the shelving system of FIG. 1, according to some embodiments.
Figure 5:
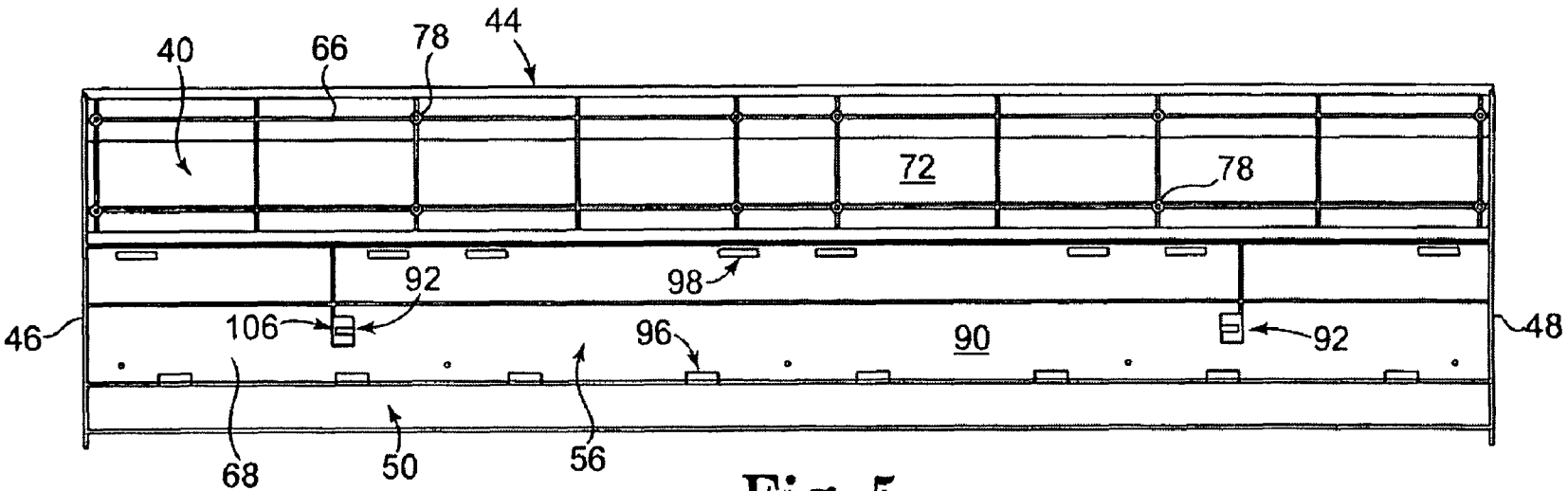
FIG. 5 is a bottom view of the base tray of FIG. 4, according to some embodiments.

FIG. 4 shows the base tray 36 from a top view and FIG. 5 shows the base tray 36 from a bottom view. As shown, the display portion 50 is located toward the front 42 of the base tray 36, extends between the first and second sides 46, 48 of the base tray 36, and forms a substantially flat viewing surface 60 (FIG. 4).

As shown more clearly in FIG. 3, the display portion 50, and in particular, the substantially flat viewing surface 60, is angled downwardly in the forward direction and relative to the support portion 52. In some embodiments, this facilitates viewing of indicia placed on the viewing surface 60 from different relative heights/positions. In some embodiments, an informational sheet (not shown) including product information or other indicia is secured on the substantially flat viewing surface 60 using a strip carrier 61 defining a mouth 62 for receiving a strip of material (not shown) or other carrier having indicia. In some embodiments, the strip carrier 61 is adhered to the flat viewing surface 60 using double sided foam adhesive, for example.

The support portion 52 of the base tray 36 is optionally adapted for a tiered display configuration, with products being supported at different heights. In particular, the support portion 52 includes a rear support tier 66 and a front support tier 68, also described as front and rear product tiers. As shown in FIG. 4, the rear support tier 66 is located toward the back 44 of the base tray 36 and is optionally disposed at a substantially higher vertical position than the front support tier 68. The rear support tier 66 optionally extends between the first and second sides 46, 48 and has a top support surface 70 (FIG. 4) that is substantially flat and horizontal overall and a bottom assembly surface 72 (FIG. 5).

As shown in FIG. 4, the rear support tier 66 also has a plurality of fixturing slots 76 that extend across the top support surface 70. The top support surface 70 also defines rear and front fence slots 77*a* (FIG. 3) that extend lengthwise along the top support surface 70. As shown in FIG. 5, the bottom assembly surface 72 forms a plurality of fastener posts 78 and is adapted to be secured to the bracket assembly 54 (FIG. 3). The fastener posts 78 are optionally substantially cylindrical including internal female threading for mating with fastening means, such as male threaded screws.

As shown in FIGS. 2 and 3, the rear support tier 66 also optionally includes a rear fence 80 and a front fence 82, each of which generally helps maintain and corral products supported on the top support surface 70. As shown in FIG. 3, the rear and front fences 80, 82 are adapted to be releasably received in the rear and front fence slots 77*a*, (FIG. 3), respectively, such that the fences 80, 82 extend substantially vertically from the top support surface 70. In some embodiments, and as shown in FIGS. 2 and 3, the rear and front fences 80, 82 also include substantially vertical teeth 84*a*, 84*b*, respectively, that are adapted to be positioned opposite one another such that teeth 84*a*, 84*b* are substantially aligned with each other upon releasably receiving the fences 80, 82 in the rear and front fence slots 77*a*. Additionally, the substantially vertical teeth 84*a*, 84*b* are optionally substantially aligned with the fixturing slots 76 (FIG. 2), such that the vertical teeth 84*a*, 84*b* and fixturing slots 76 are usable in combination with one another to retain one or more display devices, such as one or more product pushers 85 (FIGS. 1-3), as will be subsequently described.

As shown in FIGS. 4 and 5, the front support tier 68 is located between the rear support tier 66 and the display portion 50, extends between the first and second sides 46, 48, has an upper surface 86 (also described as a top surface) that forms a tray receptacle 88, and has a bottom surface 90 forming a plurality of retaining structures 92 (FIG. 5). The front support tier 68, also has a front set of tab holes 96 formed or otherwise positioned toward the display portion 50 and a rear set of snap fit holes 98 formed or otherwise positioned toward the rear support tier 66. As shown in FIG. 3, the front support tier 68 is angled downwardly in a forward direction relative to the top support surface 70 of the rear support tier 66. In some embodiments, the top support surface 70 of the rear support tier 66 and the upper surface 86 of the front support tier 68 define an angle of about five degrees to about ten degrees, for example, although a variety of angular offsets are contemplated.

As shown in FIG. 4, the tray receptacle 88, also described as a receptacle, is optionally substantially rectangular overall, although a variety of shapes are contemplated. As shown in FIG. 3, the tray receptacle 88 is adapted to receive the tray insert 26 and is formed by a front wall 100, a rear wall 102, and an upper face 104, where the receptacle 88 is substantially inset relative to the display portion 52 and rear support tier 66. The front set of tab holes 96 are formed into the front wall 100 and the upper face 104 and are optionally substantially rectangular in shape as shown in FIGS. 4 and 5, while the rear set of snap fit holes 98 are formed in the upper face 104 and are also optionally substantially rectangular in shape. Although the tab holes 96 and snap fit holes 98 are optionally substantially rectangular, a variety of shapes and positions are contemplated.

As shown in FIGS. 3 and 5, the retaining structures 92 each project downwardly and form an inner receptacle 105. The retaining structures 92 each optionally have slotted bottoms 106 which, as will be subsequently described, facilitate assembly of the lighting assembly 56 thereto.

Figure 6:
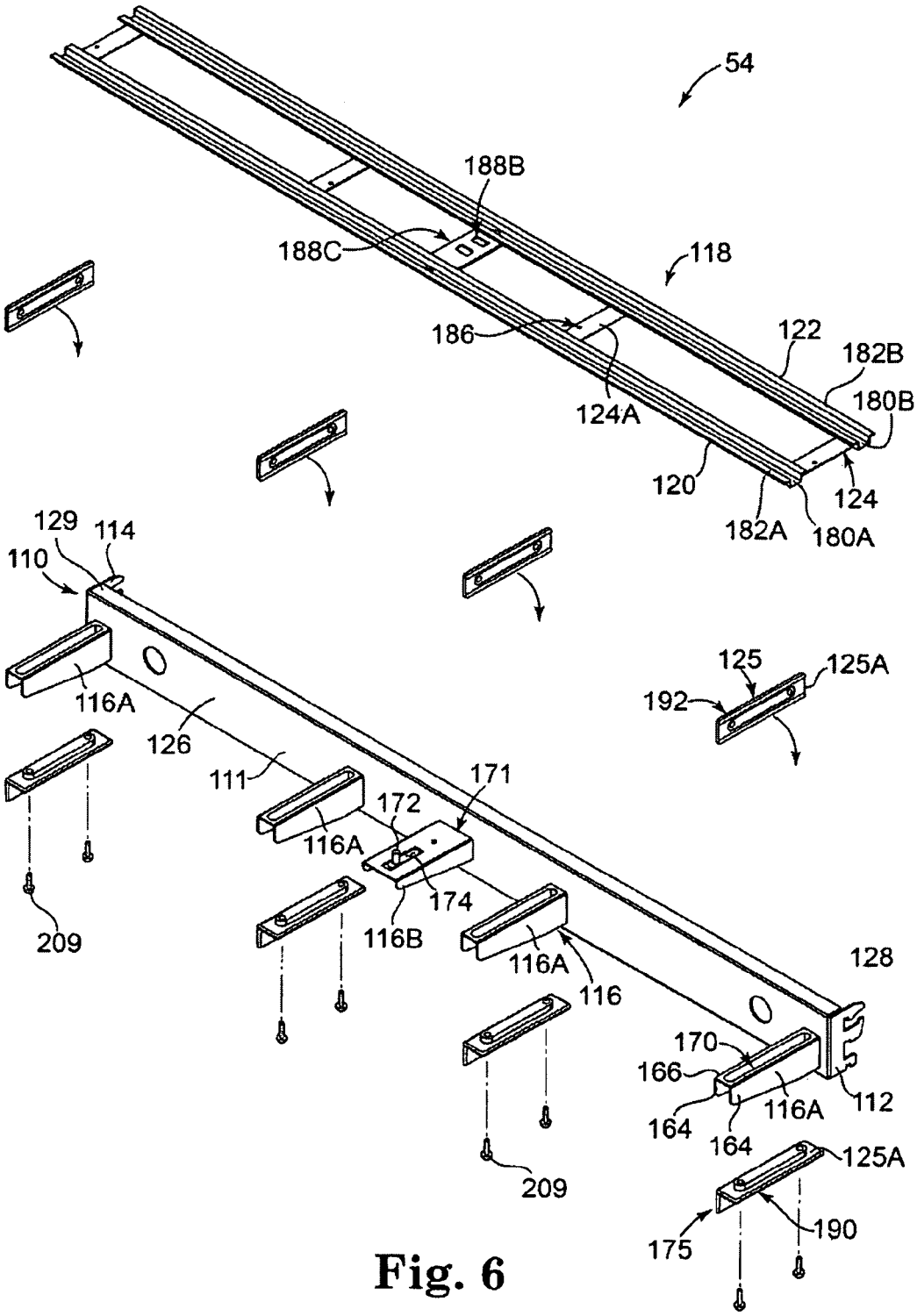
FIG. 6 is an isometric view of a bracket assembly of the system of FIG. 1, according to some embodiments.

FIG. 6 shows the bracket assembly 54, also described as a hanger assembly, in a disassembled state. The bracket assembly 54 is optionally adapted to be selectively adjustable between a plurality of positions. As shown, the bracket assembly 54 optionally includes a base member 1 10, the base member 1 10 having a body 111, at least two brackets including, a first bracket 112, a second bracket 114, and a plurality of cantilever members 116; a carriage member 118, the carriage member 118 having a front channel 120, a rear channel 122, and a plurality of cross-members 124; and a plurality of slide assemblies 125 including a first slide assembly 125A.

As shown in the cross-sectional view of FIG. 3, the body 111 of the base member 110 is optionally substantially C-shaped in transverse cross-section. As shown in FIG. 6, the body 111 includes a front face 126, a back face (not shown), a first end 128, and a second end 129. In some embodiments, the first and second brackets 112, 114 are continuously formed (e.g., by a forming process) or secured (e.g., by welding) to the first and second ends 128, 129, respectively, of the body 111. The first and second brackets 112, 114 are optionally substantially similar and thus are described cumulatively with features of the first bracket 112.

As shown in FIG. 3, the first bracket 112, also described as a keyed bracket, includes a base portion 130 and a keyed portion 132. The keyed portion 132 optionally includes a first projection 140 defining a first retaining pocket 142, a second projection 144 defining a second retaining pocket 146, and a third projection 148 defining a third retaining pocket 150. In some embodiments, the projections 140, 144, 148 and associated retaining pockets 142, 146, 150 are generally configured to help secure the first bracket 112 to the shelving unit 23.

The projections 140, 144, 148 and retaining pockets 142, 146, 150 are optionally configured to facilitate securing the first bracket 112 to standards having varied slot configurations. For example, in some embodiments, the first and second retaining pockets 142, 146 retain the first bracket 112 to the shelving unit 23. In other embodiments, the second and third retaining pockets 146, 150 or all three retaining pockets 142, 146, 150 retain the first bracket 112 to the shelving unit 23.

As shown in FIG. 3, each of the plurality of cantilever members 116 optionally tapers in thickness moving away from the body 111 and defines a substantially inverted U-shape when viewed from the front. A shown in FIG. 6, in some embodiments, the plurality of cantilever members 116 include outer slide members 116A and a central locking member 116B. Each of the outer slide members 116A optionally includes side walls 164 and a top wall 166 with an elongate slot 170. In some embodiments, the central locking member 116 has a main body 171 and a depressible button 172 maintained on flexible cantilever 174 that is secured (e.g., riveted) to the main body 171. As alluded to above, the depressible button 172 assists in selectively locking the bracket assembly 54 (and the shelf 22 more generally) in plurality of display positions, including a rearward position, an intermediate position, and a forward position.

Figure 7:
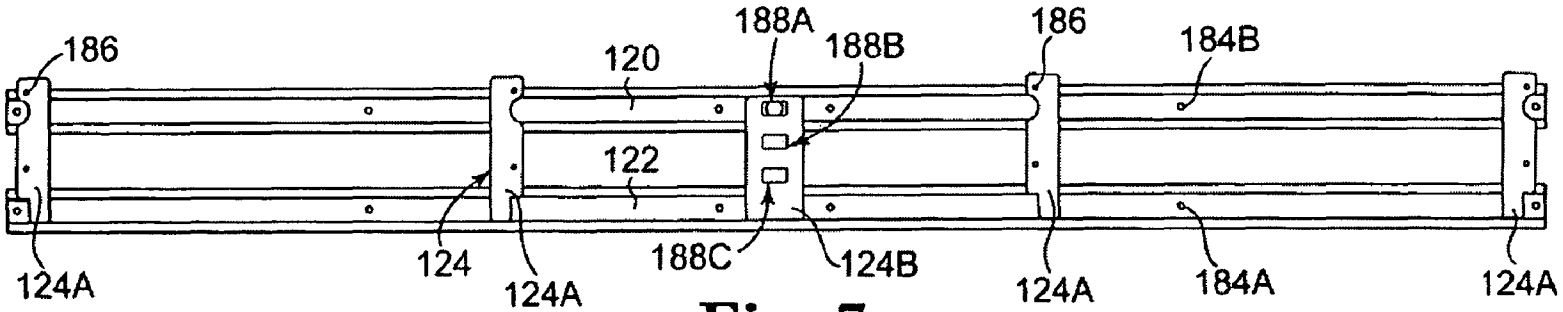
FIG. 7 is a bottom view of a carriage member of the bracket assembly of FIG. 6, according to some embodiments.

As shown in FIG. 6, the front and rear channel members 120, 122 of the carriage member 118 are optionally substantially similar in size and shape according to some embodiments, with features of the first channel member 120 designated with a reference number and the letter "A" and corresponding features of the second channel member 122 with the same reference number and a "B." The front channel member 120 and the rear channel member 122 each optionally include receptacle portions 180A, 180B, respectively, that are substantially U-shaped and pairs of wings 182A, 182B, respectively, that extend outwardly and substantially perpendicularly from the receptacle portions 180A, 180B. FIG. 7 is a bottom view of the carriage member 118. As shown, the receptacle portions 180A, 180B are adapted to receive the fastener posts 78 (FIG. 3) of the support portion 52 and include a plurality of fastener holes 184A, 184B for receiving fasteners (e.g., screws or rivets) for securing the fastener posts 78 to the front and rear channels 120, 122.

Figure 8:
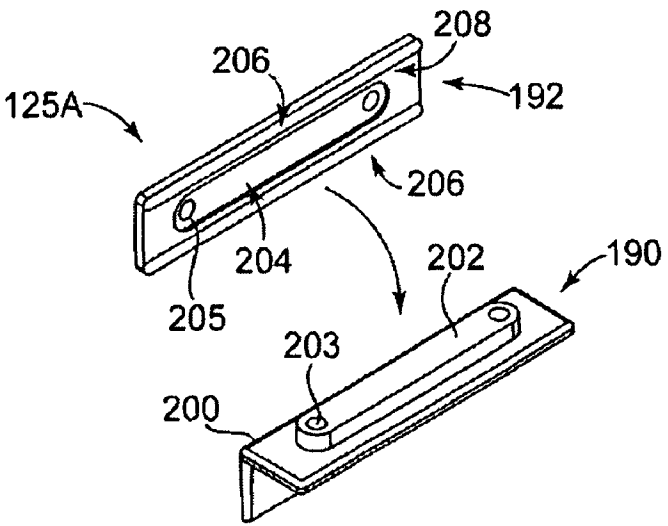
FIG. 8 is an isometric view of a slider assembly of the bracket assembly of FIG. 6, according to some embodiments.

As shown in FIG. 7, the plurality of cross-members 124 extend between and are secured to the front and rear channel member 120, 122 and generally serve to help tie or otherwise connect the front and rear channel members 120, 122 to one another. In some embodiments, the plurality of cross-members 124 include a plurality of outer cross-members 124A and a central cross-member 124B. The outer cross-members 124A include a plurality of holes 186 for securing the outer cross-members 124A to the slide assemblies 125 (FIG. 8). The central cross-member 124B includes three detent holes 188A, 188B, 188C adapted to receive the depressible button 172 (FIG. 6) of the base member 110 (FIG. 6). The three detents 188A, 188B, 188C in combination with the depressible button 172 help provide means for selectively locking the shelf 22 in the rearward position, intermediate position, and forward positions, respectively.

As shown in FIG. 6, the slide assemblies 125 are optionally substantially similar and thus are described cumulatively with reference to the first slide assembly 125A. FIG. 8 shows the first slide assembly 125A from an isometric view. As shown, the first slide assembly 125A is optionally formed of a polymeric material (e.g., polyethylene) to provide a suitable bearing surface/material, although a variety of materials, surface treatments, lubricants, and other bearing means are contemplated.

The first slide assembly 125A optionally includes a slider base 190 and a slider cap 192. The slider base 190 includes a bottom portion 200 that is optionally substantially L-shaped overall and a raised portion 202 projecting upwardly from the bottom portion 200, the raised portion 202 having fastener holes 203.

An underside of the slider cap 192 is shown in FIG. 7, where the slider cap 192 optionally defines an inset seat 204 that is substantially complementary in shape to the raised portion 202 of the slider base 190, a pair of fastener holes 205 that are substantially complementary in position to the holes 203, and a pair of rails 206 that are raised relative to a bottom face 208 of the slider cap 192. A top face (not shown) of the slider cap 192 is optionally substantially flat. As designated by the curved directional arrow, the inset seat 204 and raised portion 202 are brought together to form a complementary fit.

The bracket assembly 54 is assembled from the state shown in FIG. 6 by receiving the slider bases (e.g., slider base 190) of the slide assemblies 125 through corresponding ones of the elongate slots 170 in the outer slide members 116*a*. The slider caps (e.g., slider cap 192) are then assembled to the slider bases and the slider caps are assembled to the carriage member 118 using screws 209 or other fasteners through the plurality of holes 186 in the outer cross-members 124A. The depressible button 172 of the base member 110 is received in one of the three detents 188A, 188B, 188C of the central cross-member 124B. The bracket assembly 54, and in particular a position of the carriage member 118 relative to the base member 110, is adjusted forward and backward by depressing the button 172 and sliding the carriage member 118 forward or backward on the slide assemblies 125.

Figure 9:
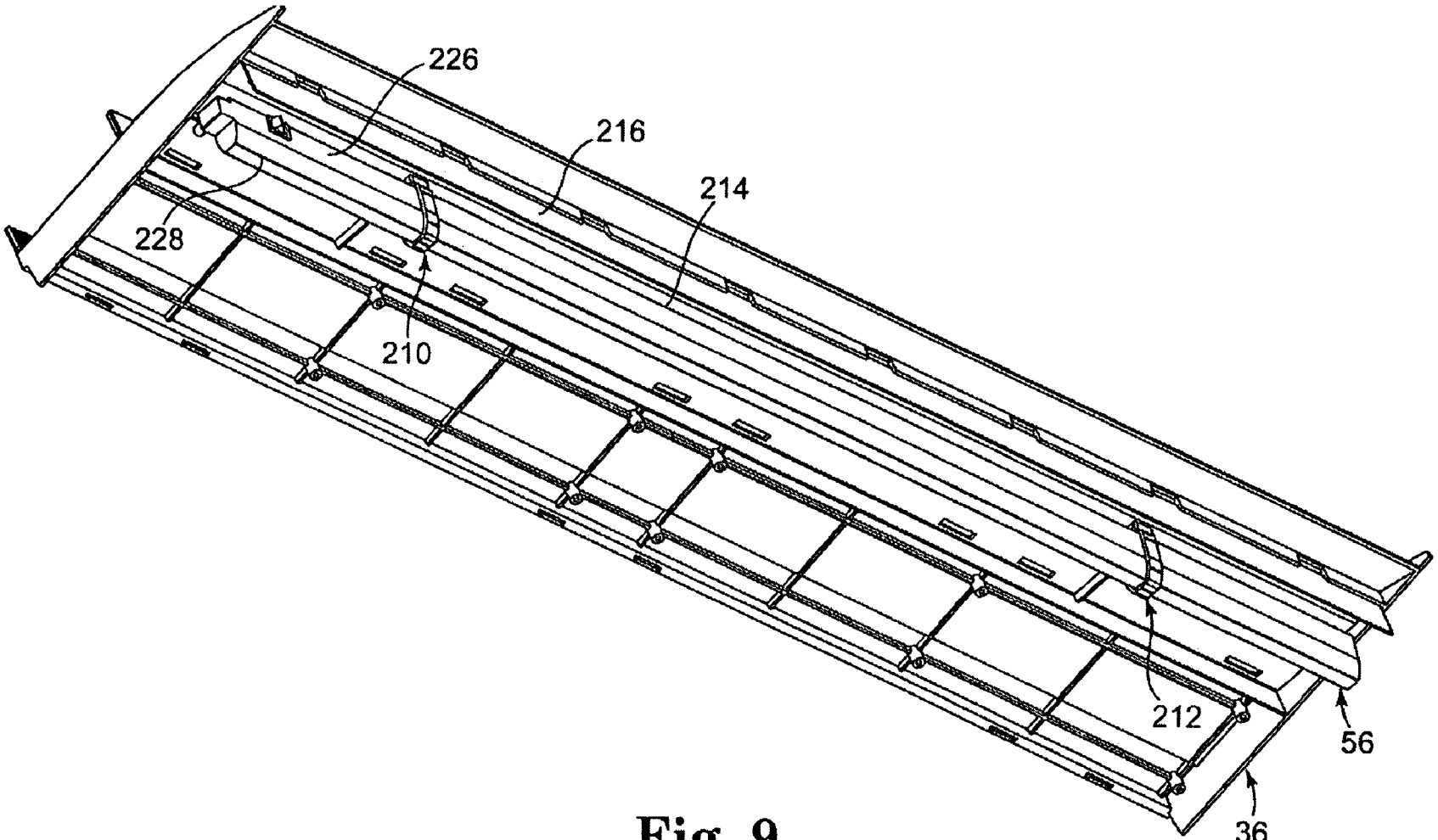
FIG. 9 is a bottom view of a base tray and light assembly of the system of FIG. 1, according to some embodiments.

The lighting assembly 56 is shown in FIGS. 3 and 9, where FIG. 9 is an isometric view of the lighting assembly 56 assembled to the base tray 36 and FIG. 3 provides a cross-sectional view of the lighting assembly 56. As shown, the lighting assembly 56 optionally includes first and second retaining clips 210, 212, a light source 214, and a light baffle 216.

The retaining clips 210, 212 are optionally substantially similar and thus are described cumulatively with reference to the first retaining clip 210. As shown in FIG. 3, the first retaining clip 210 includes a receiving ring 220 and a slotted head 222 adapted to be slidably received and retained in one of the retaining structures 92 of the base tray 36. The light source 214 is optionally of a fluorescent-type, for example, and includes a controller portion 226 and a bulb 228. As shown in FIGS. 3 and 9, the light source 214 is coaxially received in the receiving ring 220 of the first retaining clip 210. The light source 214 is also substantially similarly received in the second retaining clip 212.

The light baffle 216 is adapted to mask the light source 214 from direct viewing. In some embodiments, the light baffle 216 is a bent sheet of metal or other material suitable for masking light from the light source 214.

Figure 11:
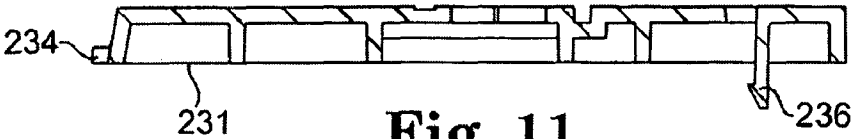
FIGS. 10-13 show a tray insert of the system of FIG. 1, according to some embodiments.
Figure 10:
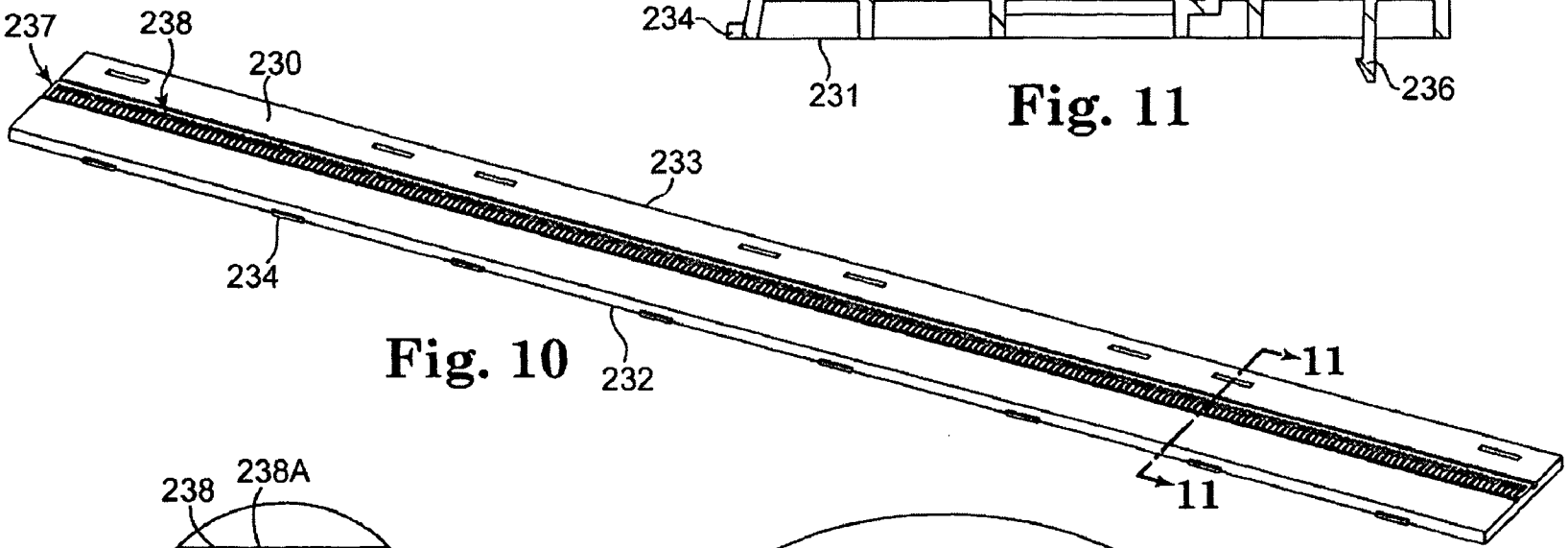

FIG. 10 shows the tray insert 26 from an isometric view and FIG. 11 shows the tray insert 26 in a cross-section taken along line 11-11 of FIG. 10. As shown in FIG. 10, the tray insert 26 is optionally substantially rectangular in shape and adapted to be received in the tray receptacle 88 (FIG. 3) of the base tray 36, although a variety of shapes are contemplated. The tray insert 26 has a top 230, a bottom 231 (FIG. 11), a front 232, and a back 233, and optionally includes a plurality of flanges 234 at the front 232 and a plurality of downwardly projecting barbs 236 (FIG. 12) toward the back 233.

In some embodiments, the tray insert 26, also described as a slotted plate, also has a channel 237 formed into the top 230 and along the length of the tray insert 26, as well as a plurality of clip slots 238 formed within the channel 237, each of the clip slots 238 being spaced substantially equidistant to one another along the length of the channel 237. In some embodiments, each of the clip slots 238 extends substantially perpendicular to the length of the tray insert 26.

Figure 12:
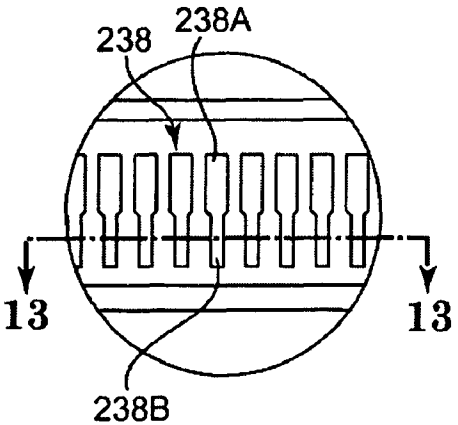

FIG. 12 is an enlarged, top down view of some of the clip slots 238. As shown, each of the clip slots 238 optionally defines a head portion 238A (also described as a front portion) and a body portion 238B (also described as a rear portion), where the head portions 238A are substantially wider than the body portions 238B. As will be described in greater detail, the head and body portions 238A, 238B help provide means for securing placement clips 30 into the clip slots 238.

Figure 13:
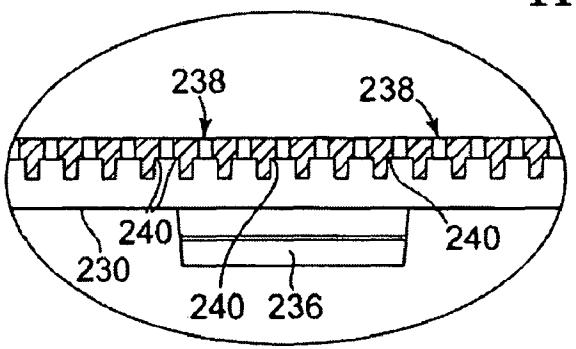

FIG. 13 is a cross-sectional view taken generally along line 13-13 of FIG. 12. As shown, the bottom 230 of the tray insert 26 defines opposing shoulders 240 adjacent each side of each of the clip slots 238. As will be subsequently described, the shoulders 240 optionally assist with securing the placement clips 30 (FIG. 1) within the clip slots 238.

As shown in FIG. 2, the template 28, also described as a cover strip, is optionally a substantially rectangular sheet of material (e.g., about 0.050 inches thick) having a plurality of clip openings 250 (also described as windows or openings) of various shapes and sizes, or substantially similar shapes and sizes, as desired. In some embodiments, the template 28 is formed of a polymeric material (e.g., polyethylene terephthalate) with paint or other masking agent on either of the top or bottom faces of the template 28. The template 28 is generally adapted to be received over the tray insert 26 and within the tray receptacle 88 (FIG. 3) of the base tray 36. As will be described in greater detail, the clip openings 250 are adapted to partially mask the tray insert 26 while selectively leaving a desired subset of the clip openings 250 exposed to allow the placement clips 30 to be secured within the subset of clip slots 238 (FIG. 13).

Figure 14:
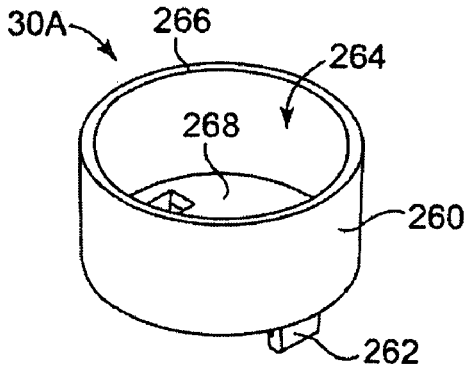
FIGS. 14-18 show various placement clips and associated structures of the system of FIG. 1, according to some embodiments.
Figure 15:
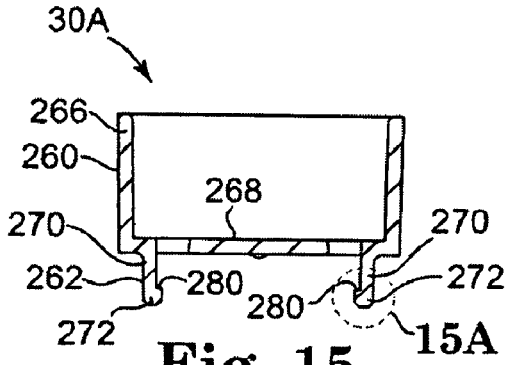

FIG. 14 shows a first placement clip 30A from an isometric view and FIG. 15 shows a cross-section of the first placement clip 30A. As shown, the first placement clip 30A optionally includes a receptacle portion 260 (also described as a base portion or upper portion) and a pair of retaining prongs 262 (also described as legs or deflectable tabs), which project from the receptacle portion 260. In some embodiments, the receptacle portion 260 is substantially cylindrical in shape and is adapted to receive a first product 32A (FIG. 1) of the lower tier of products 32 (e.g., a bottle of nail polish), although other shapes (e.g., rectangular) are contemplated. The receptacle portion 260 optionally has an open interior 264, a substantially continuous sidewall 266, and a bottom wall 268.

Figure 15A:
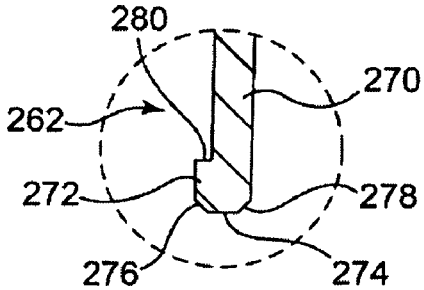

The retaining prongs 262 are adapted to be secured within the clip slots 238 (FIG. 13) of the tray insert 26, extend downwardly from the bottom wall 268, and are positioned opposite one another on opposite sides of the receptacle portion 260. The retaining prongs 262 are optionally substantially similar, each including a body 270 and a barb 272. FIG. 15A shows one of the retaining prongs 262 in greater detail. As shown, the barb 272, also described as a hooked potion, optionally includes a substantially flat end 274, an inner taper 276, an outer taper 278, and a shoulder 280. In some embodiments, the retaining prongs 262 are each adapted to be flexed outwardly, away from one another to a desired extent. Although the retaining prongs 262 are shown with shoulders 280 facing inwardly, toward one another, in other embodiments the shoulders 280 optionally face outward, away from one another.

Figure 16:
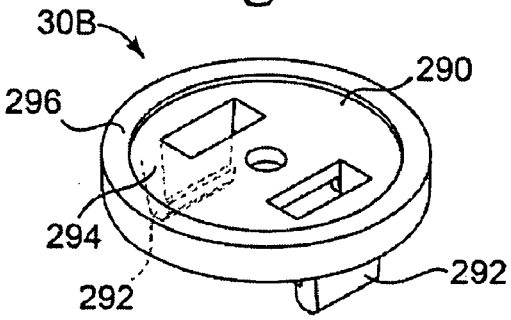

FIG. 16 shows a second placement clip 30B from an isometric view. As shown, the second placement clip 30B includes a receptacle portion 290 (also described as a base portion) and retaining prongs 292 (also described as legs or deflectable tabs) that are adapted to be secured within the clip slots 238 (FIG. 13) of the tray insert 26. The receptacle portion 290 has a recessed, central portion 294 and a raised, outer lip 296 and is adapted for receiving a second product 32B (FIG. 1) of the lower tier of products 32. As shown, the receptacle portion 290 is optionally round, although any of a variety of shapes (e.g., square, rectangular, or triangular) are also contemplated. In some embodiments, one of the lower tier of products 32 (e.g., a tube of lipstick) is adhered or otherwise secured (e.g., using magnets) to the central portion 294. In other embodiments, one of the lower tier of products 32 (e.g., a boxed item) is adhered or otherwise secured (e.g., using magnets) to the outer lip 296.

Figure 17:
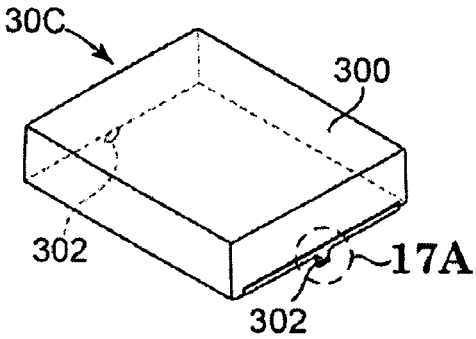
Figure 17A:
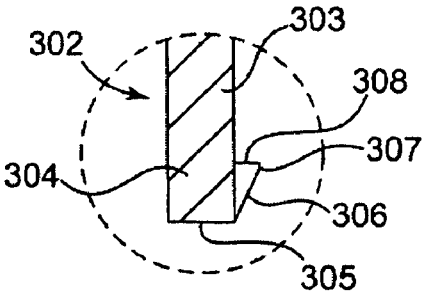

FIG. 17 shows a third placement clip 30C, also described as a museum box. As shown, the third placement clip 30C includes a cover portion 300 (also described as a base portion) and retaining prongs 302 (also described as legs or deflectable tabs). The cover portion 300 is substantially transparent and is adapted to be disposed over a third product 32C (shown in broken lines in FIG. 1) of the lower tier of products 32. The retaining prongs 302 are adapted to be secured within the clip slots 238 (FIG. 13) of the tray insert 26, extend downwardly from the cover portion 300, and are positioned opposite one another on opposite sides of the cover portion 300. The retaining prongs 302 are optionally substantially similar, each including a body 303 and a barb 304, also described as a hook portion. FIG. 17A shows one of the retaining prongs 302 in greater detail. As shown, the barb 304 optionally includes a substantially flat end 305, a sharp, outer taper 306 terminating at a point 307, and a shoulder 308. The retaining prongs 302 are each optionally adapted to be flexed outwardly, away from one another to a desired extent. Although the retaining prongs 302 are shown with shoulders 308 facing outward, away from one another, in other embodiments the shoulders 308 optionally face inward, toward from one another.

Figure 18:
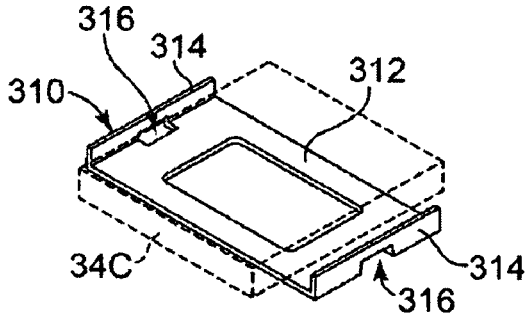

FIG. 18 shows a product stabilizer 310 that is optionally used in combination with the third placement clip 30C. As shown, the product stabilizer 31 0 includes a substantially flat body portion 312 with raised edges 314 and has prong holes 316 formed through the body portion 312 at the edges 314. In some embodiments, the third product 32C (designated generally by broken lines in FIG. 18) is secured to the substantially flat body portion 312. The third placement clip 30C is optionally placed over the product stabilizer 310 with the retaining prongs 302 received through the prong holes 316. In this manner, the product stabilizer 310 is generally maintained in place by the retaining prongs 302 such that the third product 32C attached to the product stabilizer 310 is also maintained in place.

As understood with reference to FIGS. 2 and 3, some methods of shelving products for display include assembling the tray assembly 24 by securing the carriage member 118 to the bracket assembly 54 to the base tray 36. In some embodiments, the plurality of fastener posts 78 are inserted into the front and rear channel members 120, 122 of the bracket assembly 54. The fastener posts 78 and channel members 120, 122 are secured together using fastening means (not shown) such as screws or adhesives, for example.

As understood with reference to FIGS. 3, 5, and 9, the light source 214 is secured to the base tray 36 by receiving the light source 214 in the retaining clips 210, 212 and inserting the retaining clips 210, 212 into the retaining structures 92 in the base tray 36. The light baffle 216 is optionally secured directly to the bottom surface 90 of the front support tier 68 using screws, adhesives, or other fastening means. In other embodiments, the light baffle 216 is inserted into complementary slots or channels (not shown) in the base-tray 36 and is secured therein. The light source 214 is optionally positioned to substantially mask or otherwise substantially reduce direct light from the light source 214 being shone toward viewers in front of the shelf 22.

As understood with reference to FIGS. 1-3, the tray insert 26 is optionally secured in the tray assembly 24 by inserting the flanges 234 of the tray insert 26 into the front set of tab holes 96 of the base tray 36. The tray insert 26 is rotated downwardly and seated within the tray receptacle 88 of the base tray 36. As the tray insert 26 is moved downward, the plurality of downwardly projecting barbs 236 are inserted and locked into the snap fit holes 98 in the base tray 36. As received in the tray receptacle 88, the tray insert 26 is also forwardly angled relative to the top support surface 70 rear support tier 66.

The shelf 22 is optionally secured to the shelving unit 23 using the first and second brackets 112, 114. As shown in FIG. 1, in some embodiments, the shelving unit 23 includes a shelf base fixture 319, a first standard 320 and a second standard 322, each extending substantially vertically. The first and second standards 320, 322 each include a plurality of substantially vertically aligned columns of openings 324, 326, respectively. The substantially vertically aligned columns of openings 324, 326, also described as holes or slots, are regularly spaced and are generally suitable for securing shelving (e.g., shelf 22) to the shelving unit 23. As previously referenced, the first and second brackets 112, 114 are configured to be inserted into a desired subset of the openings 324, 326 to secure shelf 22 to the shelving unit 23.

As understood with reference to FIGS. 1-3, the shelf 22 is further assembled by receiving the template 28 over the tray insert 26, where the clip openings 250 leave a desired set of the plurality of clip slots 238 exposed. As the template 28 is received against the tray insert 26 the template 28 also defines a forwardly angled viewing surface 330 (FIG. 1) relative to the top support surface 70 of the rear support tier 66 for supporting and displaying one or more of the lower tier of products 32.

One or more of the placement clips 30 (e.g., placement clips 30A, 30B, 30C) are secured through one or more of the clip openings 250 into a pair of the clip slots 238. For example, with reference to the first placement clip 30A the retaining prongs 262 are optionally inserted through one of the clip openings 250 into a pair of the clip slots 238. As the retaining prongs 262 pass into the clip openings 250 they are deflected outwardly from one another to some extent and then rebound snap into place with the barbs 272 (FIG. 15A) engaging one of the shoulders 240 (FIG. 13) adjacent each of the particular clip slots 238. As another example, as the prongs 302 of the third placement clip 30C are inserted through the product stabilizer 310, through the clip opening 250C, and into the desired set of clip slots 238, the prongs 302 are deflected inwardly and then rebound, or snap, back into place against the shoulders 240. In other embodiments, the prongs 302 are inserted into the head portions 238A without being substantially deflected and then are slid downwardly into the body portions 238B to engage the shoulders 240.

The receptacle portion 260 of the first placement clip 30A is optionally selected to be substantially larger than the corresponding clip opening 250A through which the placement clip 30A is being attached to the tray insert 26. In this manner, the receptacle portion 260 has a substantially larger footprint than the clip opening 250A such that the receptacle portion 260 overlaps the template 28, thereby engaging the template 28 and helping to releasably secure the template 28 to the tray insert 26 and tray assembly 24. In general terms, the other placement clips 30B, 30C optionally operate in a substantially similar manner to secure the template 28 to a remainder of the shelf 22.

As shown in FIG. 1, the first product 32A of the lower tier of products 32 (e.g., a cylindrical bottle of liquid foundation make up) is received in the receptacle portion 260 of the placement clip 30A where, due to the angle of the angled viewing surface 330, the first product 32A as received in the placement clip 30A is angled forwardly toward a viewer standing in front of the shelf 22. In some embodiments, the first product 32A is secured in the receptacle portion 260 (e.g., using an adhesive or magnet materials). In other embodiments, the first product 32A is simply received in the receptacle portion 260 and is readily removable from the receptacle portion 260 to be handled by a consumer or other person.

The second product 32B of the lower tier of products 32 (e.g., a bottle of nail polish) is secured to the receptacle portion 290 of the second placement clip 30B, for example using adhesives or other fastening means. The second placement clip 30B is then secured to the tray insert 26 through a second one of the clip openings 250B in any of the manners previously described in association with the first placement clip 30A. In some embodiments, the angle of the angled viewing surface 330 orients the product 32B forwardly toward a viewer in front of the shelf 22.

The third product 32C (shown in broken lines) is received within the cover portion 300 of the third placement clip 30C. As previously described in association with other placement clips 30, the third product 32C is optionally secured to product stabilizer 310 and the retaining prongs 302 of the placement clip 30C are inserted through the product stabilizer 310 (FIG. 19), through a second clip opening 250B of the plurality of clip openings 250, and into a desired pair of the clip slots 238. In this manner, the third product 32C is able to be viewed under the substantially transparent cover portion 300 substantially enclosing the product 32C, although removal and handling of the third product 32C is substantially reduced or prevented as the product 32C is covered.

Although three placement clips 30 and associated products 32 are described, it should be understood that any number of products 32 and clips 30 are employed and with any of a variety of arrangements of clip openings 350 in the template 28. In at least this manner, the shelf 22 provides a significant degree of versatility in display configuration, where the shelf 22 is usable with a variety of different products secured to different types of placement clips 30 in a variety of different display configurations.

The upper tier of products 34 (e.g., boxes of products such as cosmetics) are stacked on the top support surface 70 of the rear support tier 66 as desired. In some embodiments, one or more product pushers, such as the product pusher 85 shown in FIGS. 1-3 is assembled to the rear support tier 66 using the substantially vertical teeth 84*a*, 84*b* of the rear and front fences 80, 82 in combination with the fixturing slots 76 (FIG. 2) in the top support surface 70. A variety of designs for the product pusher 85 are acceptable, but in some embodiments and as shown in FIG. 3, the product pusher 85 optionally includes a spring loaded push member 350 secured to a base 352 having a front flange 354 secured under one of the vertical teeth 84*a*, a rear flange 356 secured under one of the teeth 84*b*, and a bottom flange 358 secured into one of the fixture slots 76.

In general terms, the upper tier of products 34 are supported at a substantially higher elevation and at a different angular orientation than the lower tier of products 32 with the top support surface 70 and the angled viewing surface 330 forming a trailing product support platform and a leading product support platform that facilitate viewing of both the upper tier of products 34 and the lower tier of products 32. Additionally, some product arrangements include utilizing the lower tier of products 32 to present tester products for viewing or handling, while the upper tier of products 34 are fully packaged products for purchase by the viewer after viewing and handling the lower tier of products 32.

A variety of assembly sequences and combinations thereof are contemplated, although in some embodiments the shelf 22 is sent to a retailer or other recipient in a pre-assembled state with the template 28, placement clips 30, and tiers of products 32, 34 already situated in a display position. In other embodiments, the recipient previously receives the tray assembly 24 and tray insert 26 and is subsequently sent a kit of parts including the template 28; the placement clips 30; the tiers of products 32, 34; and instructions for assembling the template 28, the placement clips 30, and the tiers of products 32, 34 to the tray assembly 24 and/or insert 26. A variety of different kits of parts (not shown) including different template(s), placement clip(s), product(s), and instructions are optionally provided to the recipient as desired for assembly of a plurality of different product displays.

In some embodiments, additional display variations are optionally accomplished by adjusting a forward position of the shelf 22. As previously referenced, a forward and backward position of the carriage member 118 carrying the base tray 36 is able to be adjusted relative to the base member 110 by depressing the button 172 (FIG. 6) and sliding (e.g., pulling or pushing) the carriage member 118 on the slide assemblies 125 (FIG. 8). In this manner, the base tray 36 is able to be moved forward and away from the shelving unit 23 to a desired offset from the shelving unit 23 corresponding to the rearward position, the intermediate position, and the forward position previously described.

Figure 19:
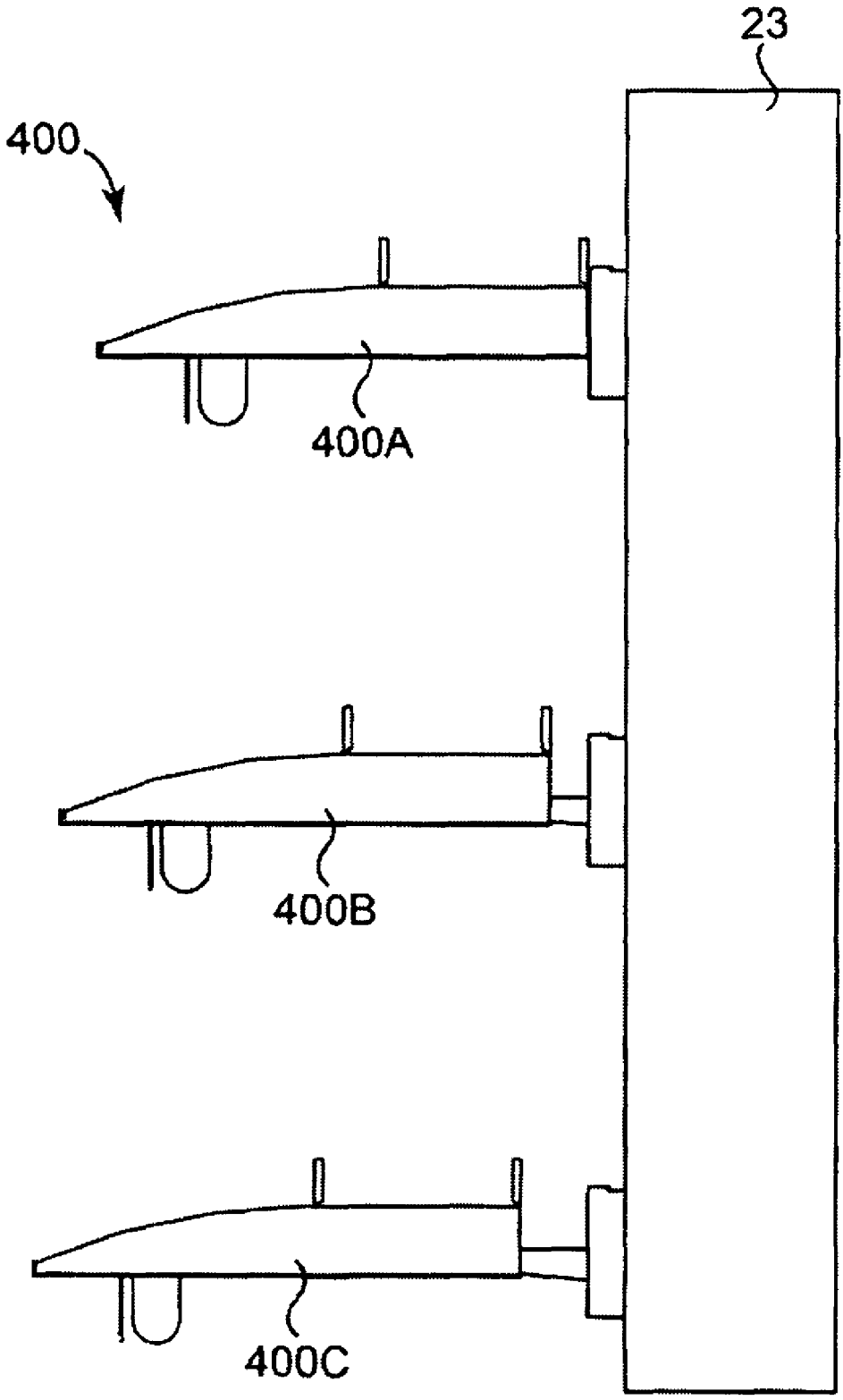
FIG. 19 shows a staggered set of shelves of the system of FIG. 1, according to some embodiments.

Accordingly, and as shown in FIG. 19, some embodiments of displaying further include securing a plurality of the shelves 400 to the shelving unit 23 at different heights, each of the shelves 400 optionally being substantially similar to the shelf 22. As shown, a first shelf 400A of the plurality of shelves 400 is positioned at the first forward position. A second shelf 400B of the plurality of shelves 400 is positioned at the second forward position such that it extends outwardly moreso than the first shelf 400A. A third shelf 400C of the plurality of shelves is positioned at the third forward position such that it extends outwardly moreso than the second shelf 400B. Although the shelves 400 are shown with each extending further than the next one down, it should be understood that the shelves 400 are each optionally offset from the shelving unit 23 with any combination of relative offsets as desired. In at least this manner, the shelves 400 provide means for providing staggered and waterfall shelving arrangements. By configuring the shelves 400 at different forward offsets, an attractive and useful display is provided, where the viewer is able to better see products (not shown) displayed on each of the shelves 400.

In view of the foregoing, various embodiments of the shelving system 20 have been shown and described that provide a versatile shelving system adapted to allow relatively quick assembly to product shelving associated therewith. In some embodiments, the products are displayed in a tiered set up on the rear support tier 66 and a front support tier 68. The front support tier 68 is optionally angled toward a viewer standing in front of the shelving system 20 to enhance visualization of products on both the front and back support tiers 66, 68 and promote access thereto. The tray insert 26, the template 28, and the placement clips 30 provide an effective and efficient means for removably attaching the lower tier of products 32 to the shelf 22. Additionally, the forward and backward adjustability of the shelf 22 provides versatility in display arrangements, including means for providing staggered and waterfall shelving effects.

The ease of use of the system 20, along with enhanced visualization and product access, encourage efficient shelving set up and promote retail sales, although a variety of additional and/or alternate features are optionally accomplished with embodiments of the system 20. Various modifications and additions can be made to the embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

In the description, reference is made to the accompanying drawings, which form a part hereof, and in which is shown by way of illustration specific embodiments in which the invention may be practiced. In this regard, directional terminology, such as "top," "bottom," "front," "back," "left," "right," etc., is used with reference to the orientation of the Figure(s) being described. Because components of the various embodiments can be positioned in a number of different orientations, the directional terminology is used for the purposes of illustration and is in no way limiting. The detailed description, therefore, is not to be taken in a limiting sense, and the scope of the present invention is defined by the appended claims.

The following is claimed:

1. A shelving system comprising:

a product;

a base having a top surface forming a receptacle and including a hanger assembly for releasably securing the base to a shelving unit positioned in a retail environment;

a tray insert releasably secured into the receptacle formed in the top surface of the base, the tray insert having a plurality of slots spaced along a length of the tray insert;

a template received over the tray insert to cover the tray insert, the template having a plurality of openings through the template to selectively expose a desired subset of said slots of said tray insert; and a placement clip releasably secured through one of the openings in the template into a pair of the desired subset of said slots of said tray insert, wherein one of the plurality of openings in the template is sized and shaped according to a size and shape of the placement clip, and wherein the size of the one of the plurality of openings is different from a size of the pair of the desired subset of said slots, the placement clip acting to releasably secure the template to the tray insert and being adapted to maintain the product; wherein the top surface of the base forms a front product tier and a rear product tier sized for supporting the product, the front product tier including the receptacle and the rear product tier being defined in a space between a pair of fences and being disposed at a substantially higher vertical position than the front product tier, and wherein the front product tier is angled forwardly and downwardly and the rear product tier extends substantially horizontally relative to the front product tier.

2. The system of claim 1, wherein the base defines a front edge and a rear edge, the hanger assembly being positioned at the rear edge, and the hanger assembly includes at least two brackets each having a keyed portion adapted to be releasably secured into a vertically aligned column of slots.

3. The system of claim 1, wherein each of the plurality of slots in the tray insert includes a front portion and a rear portion, the front portion being substantially wider than the rear portion.

4. The system of claim 1, wherein the placement clip includes a pair of vertically extending legs, each leg having a hooked portion adapted to be secured in place in a respective one of the desired subset of slots.

5. The system of claim 4, wherein the placement clip includes a base portion from which the pair of vertically extending legs projects, the base portion having a substantially larger footprint than the one of the openings through which the placement clip is secured into the pair of the desired subset of slots.

6. The system of claim 1, wherein the placement clip includes a transparent cover substantially enclosing the product.

7. A shelving system comprising:

a product;

a base having a top surface forming a receptacle and including a hanger assembly for releasably securing the base to a shelving unit positioned in a retail environment;

a tray insert releasably secured into the receptacle formed in the top surface of the base, the tray insert having a plurality of slots spaced along a length of the tray insert;

a template received over the tray insert to cover the tray insert, the template having a plurality of openings through the template to selectively expose a desired subset of said slots of said tray insert; and a placement clip releasably secured through one of the openings in the template into a pair of the desired subset of said slots of said tray insert, wherein a size of one of the plurality of openings is different from a size of the pair of the desired subset of said slots, the placement clip acting to releasably secure the template to the tray insert and being adapted to maintain the product, wherein the top surface of the base forms a front product tier and a rear product tier sized for supporting the product, the front product tier including the receptacle and the rear product tier being defined in a space between a pair of fences and being disposed at a substantially higher vertical position than the front product tier, and wherein the front product tier is angled forwardly and downwardly and the rear product tier extends substantially horizontally relative to the front product tier.

8. The system of claim 1, wherein the product is adhered to the placement clip.

9. The system of claim 1, wherein the placement clip includes a cup portion and the product is releasably received in the cup portion.

* * * * *